United States Patent [19]

Lee

[11] 4,318,654

[45] Mar. 9, 1982

[54] TENNIS BALL RETRIEVING DEVICE

[75] Inventor: Delbert Lee, Riverside, Calif.

[73] Assignee: Alpha Nova Engineering Corp., Irvine, Calif.

[21] Appl. No.: 172,532

[22] Filed: Jul. 28, 1980

[51] Int. Cl.[3] ..... B60P 1/00

[52] U.S. Cl. ..... 414/440; 294/19 A

[58] Field of Search ..... 294/19 A; 414/440, 439; 171/63, 58; 56/37.8 R; 280/411 R, 481

[56] References Cited

U.S. PATENT DOCUMENTS

| | | | |
|---|---|---|---|
| 2,651,902 | 9/1953 | Curry | 414/440 |
| 3,175,714 | 3/1965 | Wittek | 414/440 |
| 4,066,179 | 1/1978 | Livingston | 414/440 |

*Primary Examiner*—James B. Marbert

*Attorney, Agent, or Firm*—William C. Babcock

[57] ABSTRACT

A frame assembly rotatably supported on a pair of laterally spaced wheels that have resilient rims that will not damage the surface of a tennis court as they roll thereon, said frame assembly including an elongate tennis ball receiving basket mounted on the forward portion thereof, with the bottom of the basket at a height above the tennis court surface greater than the diameters of tennis balls resting in random positions on the surface, and the frame including an upwardly and rearwardly extending handle. A shaft extends transversely between aligned opening in laterally spaced legs that form a part of the frame assembly. A tennis ball retrieving assembly that includes laterally spaced pairs of resilient disks is rotatably supported on the shaft, with the lateral spacing between each pair of disks being less than the diameter of a tennis ball, and each pair of disks having beads on the periphery that removably maintain a tennis ball that has entered the annulus space between a pair of disks therein. The retrieving assembly has first clutch means on opposite ends thereof that at all times pressure contact spring loaded clutch means on the wheels, and as a result the wheels and disks rotate concurrently when the invention is moved forwardly. The disks are of lesser diameters than the wheels and do not contact the tennis court surface. A number of spaced extractors displace tennis balls from the annulus spaces and direct the balls into the basket as the invention is moved forwardly over the surface of a tennis court. Means are provided to prevent the wheels and disks rotating when the invention is moved rearwardly.

8 Claims, 7 Drawing Figures

FIG. 1
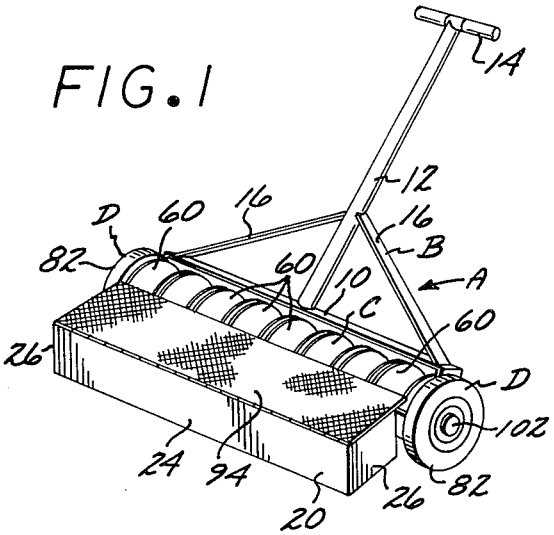
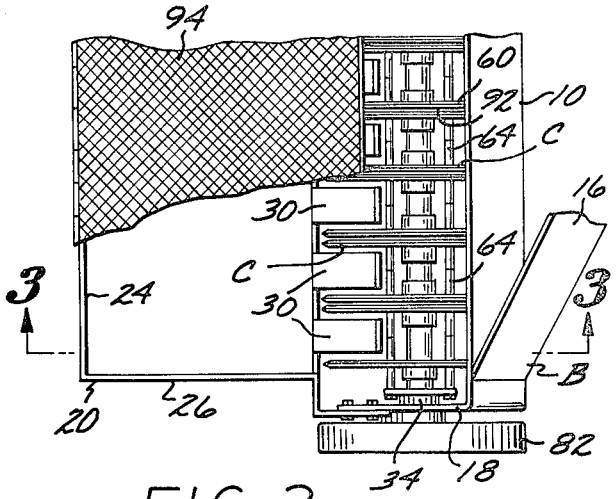
FIG. 2
FIG. 3
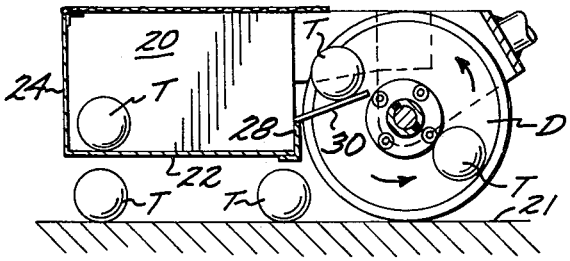
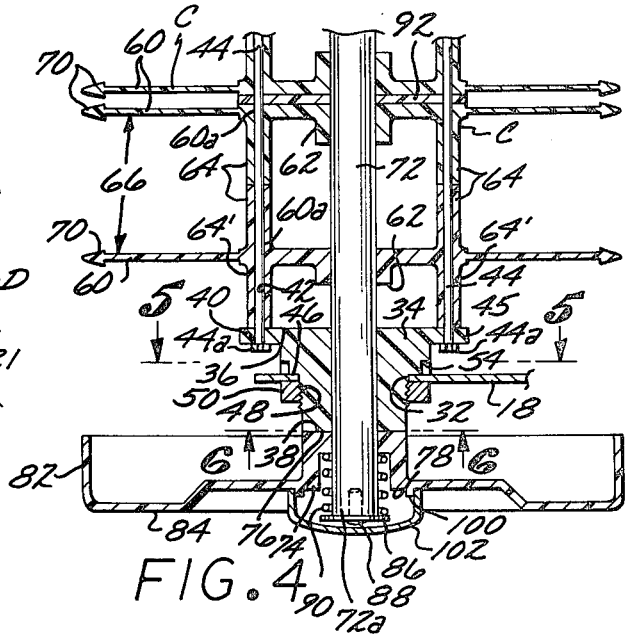
FIG. 4
FIG. 5
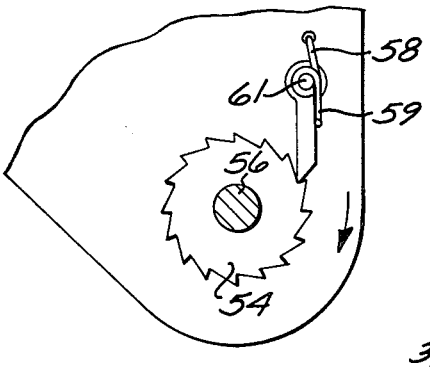
FIG. 6
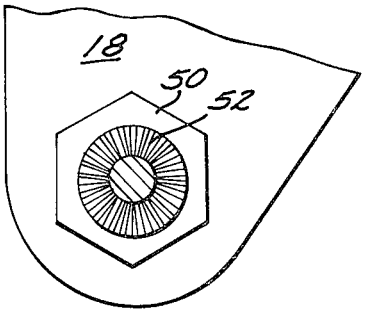
FIG. 7
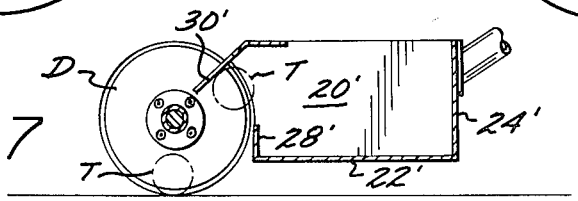

TENNIS BALL RETRIEVING DEVICE

BACKGROUND OF THE INVENTION

1. Field of the Invention

Tennis ball retrieving device.

2. Description of the Prior Art

In tennis instruction, it is common practice for the instructor to have a hundred or so tennis balls that he serves, drives or lobs towards a student to improve the form and agility of the latter. At the end of such a practice session the balls are scattered at random over the surface of the tennis court. It is time consuming and annoying to have to retrieve the balls and place them in a container for another practice session.

A major object of the present invention is to supply a tennis ball retrieving device that may be rolled over the surface of a tennis court without doing physical damage thereto, and will automatically retrieve and place randomly positioned tennis balls in an elongate basket.

Another object of the invention is to furnish a tennis ball retrieving device that is simple and easy to operate, minimizes the time required to retrieve a number of tennis balls, has a simple mechanical structure, requires a minimum of maintenance attention, and can be retailed at a sufficiently low price as to encourage the widespread use thereof.

SUMMARY OF THE INVENTION

The tennis ball retrieving device of the present invention includes a number of laterlaly spaced pairs of resilient disks rotatably mounted on a horizontal transverse shaft that forms a part of a frame assembly. The assembly includes an elongate transverse basket disposed forwardly of the disks and having a number of spaced extractors extending into the annulus spaces between the disks in which retrieved tennis balls are temporarily lodged. The frame assembly is rotatably supported by a pair of laterally spaced wheels of greater diameter than the disks. Clutch means cause the disks to rotate concurrently with the pair of wheels as the latter roll over the surface of tennis courts. The pair of wheels have resilient rims that will not damage the surface by physical contact therewith. Means are provided to prevent the disks rotating clockwise when the device is pulled in a rearward direction. Such clockwise rotation of the disks is undesirable as the retrieved balls would contact the undersides of the extractors and be displaced from the annulus spaces between the pairs of disks.

The pairs of disks are laterally spaced on the shaft to permit each pair to deform laterally when gripping a retrieved tennis ball without contacting the pair of disks adjacent thereto.

BRIEF DESCRIPTION OF THE DRAWINGS

FIG. 1 is a perspective view of the tennis ball retrieving device;

FIG. 2 is a partial top plan view of the device;

FIG. 3 is a transverse cross-sectional view of the device taken on the line 3—3 of FIG. 2;

FIG. 4 is a partial transverse cross-sectional view of the device;

FIG. 5 is an end elevational view of the mechanism to prevent rotation of the pairs of tennis ball retrieving disks when the device is moved rearwardly.

FIG. 6 is a transverse cross sectional view of the invention taken on the line 6—6 of FIG. 4; and FIG. 7 is an end elevational view of an alternate form of the invention.

DESCRIPTION OF THE PREFERRED EMBODIMENT

The tennis ball retrieving invention A as best seen in FIG. 1 includes a frame assembly B. The frame assembly B includes an elongate cross-piece 10 from which a handle 12 extends upwardly and rearwardly to terminate in a transverse grip 14. A pair of angularly disposed reinforcing members 16 extend outwardly from handle 12 and are secured to cross piece 10. A pair of laterally spaced parallel legs 18 extend forwardly from cross-piece 10 as shown in FIGS. 2 and 3.

An elongate basket 20 is provided for receiving tennis balls T that are scattered at random on a surface 21 of a tennis court (not shown). Basket 20 includes a flat bottom 22 disposed a height above the surface 21 greater than the diameter of one of the tennis balls T. The basket 20 includes a forward wall 24, a pair of side walls 26, and a relatively short upwardly extending side wall 28 from which a number of longitudinally spaced tennis ball extractors 30 extend upwardly and rearwardly from rear wall 28 as shown in FIGS. 2 and 3.

The invention A includes a tennis ball retrieving assembly C as shown in FIGS. 2 and 3. The legs 18 have aligned transverse openings 32 therein that rotatably support a pair of first hubs 34, one of which may be seen in detail in FIG. 4. Each first hub 34 includes a flat inner end surface 36, a flat outer end surface 38, with a circular flange 40 projecting outwardly from the hub adjacent the inner end surface. The pair of flanges 40 on the first pair of hubs 34 have a number of circumferentially spaced, axially aligned transverse bores 42 formed therein. A number of parallel rods 44 are provided that extend through the aligned pairs of bores 42, with the rods having threaded end portions 44*a* projecting from the pair of flanges.

Each of the first hubs 34 as may be seen in FIG. 4 has a circumferential body shoulder 46 defined thereon that is disposed inwardly from the associated leg 18. Each first hub 34 as may best be seen in FIG. 4 has threads 48 defined on the exterior surface thereof outwardly from the associated leg 18. Each set of threads 48 is engaged by a first nut 50 to rotatably secure one of the first hubs 34 to the associated leg 18. The outer end 38 of each first hub 34 has a first serrated clutch face 52 defined thereon as shown in FIG. 6.

Each of the first hubs 34 adjacent the body shoulder 46 has a ratchet wheel 54 mounted thereon on which a number of triangular shaped teeth are defined that are engaged by a dog 59 pivotally supported on a pin 61 and the dog urged into pressure contact with the teeth by a spring 58. The dog 59 allows rotation of the ratchet wheel 54 only when the ratchet wheel rotates in a counter-clockwise direction as viewed in FIG. 5.

The tennis ball retrieving assembly C includes a number of pairs of resilient disks 60 that have centered cylindrical hubs 62 best seen in FIG. 4. The disks 60 have a number of circumferentially spaced openings 60*a* therefrom which tubular bosses 64 extend. The tubular bosses 64 when in abutting contact cooperate to so maintain a pair of the disks 60 that an annulus space 66 is defined between the disks that has a width slightly less than the diameter of one of the tennis balls T. Each pair of disks 60 has a ring shaped spacer 92 therebetween.

An elongate shaft 72 is provided that rotatably engages the pair of first hubs 34, cylindrical hubs 62 and spacers 92. The resilient pairs of disks 60 have beads 70 on the peripheries thereof that extend inwardly towards one another and serve to prevent a tennis ball T inadvertently escaping from the space 66 in which it is temporarily disposed. The shaft 72 has end portions 72*a* that extend outwardly a substantial distance beyond the first hubs 34.

A pair of laterally spaced wheels D are provided that have an external diameter greater than that of the disks 60 as shown in FIGS. 3 and 4. Each of the wheels D includes a third hub 74 that has a flat inner end 76 and outer end 80. The inner end 76 defines a second clutch surface 52' that is of the same configuration as clutch surface 52. Each wheel includes a resilient flat circular rim 82, or in lieu thereof a tire (not shown) that may be rolled across the tennis court surface 21 shown in FIG. 3 without defacing the same. A circular web 84 is illustrated as extending between each third hub 74 and associated rim 82. It will be apparent that spokes (not shown) may be used in lieu of web 84 if desired.

The ends of the shaft 72 have stop plates 84 removably secured thereto by screws 88. A pair of compressed helical springs 90 encircle shaft end portions 72*a*, with one end of each spring abutting against a stop plate 86 and the other end against a third hub 74 to urge clutch surfaces 52 and 52' into pressure engagement. The projecting threaded end portions 44*a* are removably engaged by nuts 45.

The pairs of disks 60 are separated by ring-shaped spacers 92. When the tennis ball retrieving device A is rolled forwardly over the surface 21, rotation of the wheels D in a counter clockwise direction as viewed in FIG. 1 causes the clutch surfaces 52 to rotate concurrently in a counter-clockwise direction. When a tennis ball T is encountered on the surface 21 by a pair of disks 60, the forward portions of the disks 60 are moving downwardly relative thereto and the ball is forced into the annulus space 66 of width 66*a* between the disks. The width 66*a* is slightly less than the diameter of a tennis ball T and the portions of the pair of disks 60 gripping the ball are forced outwardly. However, each pair of disks 60 is separated from the pair adjacent thereto by a spacer 92, and as a result each pair of spacers 60 may deform laterally without contacting the pair adjacent thereto.

As may be seen in the drawings, particularly FIG. 4, all of the disks 60 are of the same structure except the disks 60 adjacent the first hubs 34, which have bosses 64' projecting outwardly therefrom to contact flanges 40. The bosses 64' may at the option of the manufacturer be formed as an integral part of the end disks, or be separate and abut against the flanges 40 and disks 60 when mounted on rods 44. The nuts 45 when threaded on end portions 44*a* of rods 44, cooperate with the pair of flanges 40, bosses 64' bosses 64, spacers 92, and rod 72 to the tennis ball retrieving assembly C together as an integral unit. The ratchet wheels 54 rotate concurrently with the first hubs 34 and the dogs 59 prevent the tennis ball retrieving assembly rotating clockwise when the invention A is pulled rearwardly. Such clockwise direction of the retrieving assembly C is undesirable as retrieved tennis balls between pairs of disks C are forced upwardly against the extractors 30 and displaced from the spaces between pairs of disks.

In FIG. 3 it will be seen that as the invention A is moved forwardly over the surface 21 the wheels D rotate counterclockwise and by cooperation of the clutch faces 52 the assembly C does likewise and the tennis balls T being picked up and lodged in the spaces 66 between the pairs of disks 60. The lodged tennis balls T as may be seen in FIG. 3 are rotated counterclockwise by the disks 60 until they contact extractors 30 to be dislodged from the disks and roll fowardly to drop into the basket 20. The hinged top 94 prevents balls T being inadvertently displaced from the basket 20 during the time they are being retrieved from the surface 21. Each wheel D has a circular rib 100 extending outwardly therefrom that is removably engaged by a resilient hub cap 102.

An alternate form of the invention is shown in FIG. 7, that operates in the same manner as the invention A, with like components of the invention A in the alternate form being identified by the same numerals and letters previously used, but the primes added thereto. The invention shown in FIG. 7 differs from invention A illustrated in FIG. 1 in that the basket 20' and member 30' are rearwardly disposed rather than forwardly disposed to the wheels D. The use and operation of the invention has been explained previously in detail and need not be repeated.

What is claimed is:

1. A device for retrieving a plurality of tennis balls scattered at random over a tennis court without damaging the surface of said court, said device including:

a. a frame assembly that includes an elongate cross-piece, a handle that extends upwardly and rearwardly from said cross piece, a pair of laterally spaced parallel legs that extend forwardly from said cross piece, an elongate tennis ball receiving basket that includes a bottom, a forward wall, a pair of side walls secured to said legs, a rearward wall, and a plurality of parallel laterally spaced, rearwardly extending tennis ball extractors, a pair of aligned openings formed in said legs;

b. a tennis ball retrieving assembly that includes a pair of first hubs rotatably supported in fixed positions in said openings in said legs, each of said first hubs having an inwardly and outwardly disposed flat end surface, a pair of circular flanges that projects outwardly from said inner ends of said first hubs, a plurality of circumferentially spaced parallel rods that extend between said flanges, a plurality of pairs of resilient disks that are engaged by said rods, each of said pairs of disks laterally spaced a distance less than the diameter of one of said tennis balls, each of said pair of disks including a pair of axially aligned second hubs, a plurality of ring-shaped spacers disposed between said pairs of disks, and a plurality of beads on the outer peripheries of said disks that extend towards one another and serve to removably maintain a tennis ball within the space between said pair of disks, and said outer ends of said first hubs having first clutch surfaces defined thereon;

c. an elongate shaft that rotatably supports said first and second hubs and said spacers, said shaft having end portions that project outwardly from said first hubs;

d. a pair of wheels that include third hubs that have inner and outer end surfaces, said third hubs rotatably supported on said outwardly projecting end portions of said shaft, said inner ends of said third hubs defining second clutch surfaces, said wheels including resilient rims of a greater external diameter than that of said pairs of disks, and said pair of wheels including rigid means that extend outwardly from said third hubs to said rims;

e. a pair of stops mounted on the extremities of said shaft;

f. a pair of compressed helical spring means that extend between said stops and third hubs that at all times tend to maintain said first and second clutch faces in engagement for said pairs of disks to so rotate that the forward portions of each of said pairs of disks that encounters a tennis ball on said court to be moving downwardly relative thereto to force said tennis ball into the annular space between said pair of disks and said beads on said pair of disks serving to prevent said tennis ball escaping therefrom until said tennis ball has been rotated to encounter one of said tennis ball retrievers to be displaced from between said pair of disks and roll forwardly into said basket, with said randomly scattered tennis balls on said court being retrieved and deposited in said basket as said device is moved over the surface of said court; and g. means for preventing said plurality of pairs of disks rotating when said device is rolled rearwardly.

2. A device as defined in claim 1 in which said disks are formed from a resilient polymerized resin, and said device in addition including:

h. a plurality of tubular bosses that encircle said rods and are disposed between said pairs of disks, to maintain each of said pairs of disks laterally spaced a distance less than the diameter of the tennis ball that is to be retrieved.

3. A device as defined in claim 2 in which each of said disks in a pair thereof has a plurality of said tubular bosses projecting from a first side thereof, said tubular bosses in each of said pairs of disks having free ends of said tubular bosses in abutting contact with one another, and said abutting tubular bosses of each of said pairs being of such lengths that the lateral spacing between first sides of said pairs of disks is less than the diameter of the tennis ball that is to be retrieved.

4. A device as defined in claim 3 in which said tubular bosses are integral parts of the pair of said disks.

5. A device as defined in claim 2 which also includes a plurality of tubular bosses that encircle said roda and are disposed between said flanges and the end ones of said plurality of pairs of disks to maintain said end disks in laterally spaced relationship with said flanges.

6. A device as defined in claim 1 in which said beads are of generally arrow-head transverse cross-section.

7. A device as defined in claim 1 in which said pairs of disks are sufficiently spaced from one another for two of said pairs of disks that are adjacently disposed to each retrieve a tennis ball at substantially the same circumferential positions thereon and deform outwardly as a result thereof without contacting one another.

8. A device as defined in claim 1 in which said means for preventing said plurality of pairs of disks rotating when said device is rolled rearwardly includes:

h. at least one toothed ratchet wheels mounted on one of said first hubs;

i. a dog pivotally supported from one of said legs; and j. spring means that at all times urge said dog into contact with said ratchet wheels, said ratchet wheel and dog cooperating to allow said plurality of pairs of disks to be driven by said pair of wheels only when said device is moved forwardly by said handle.

* * * * *